US006515632B1

(12) United States Patent
McLean

(10) Patent No.: US 6,515,632 B1
(45) Date of Patent: Feb. 4, 2003

(54) MULTIPLY-FED LOOP ANTENNA

(75) Inventor: James S. McLean, Austin, TX (US)

(73) Assignee: TDK RF Solutions, Cedar Park, TX (US)

( * ) Notice: Subject to any disclaimer, the term of this patent is extended or adjusted under 35 U.S.C. 154(b) by 0 days.

(21) Appl. No.: 09/905,150

(22) Filed: Jul. 12, 2001

Related U.S. Application Data

(60) Provisional application No. 60/296,542, filed on Jun. 6, 2001.

(51) Int. Cl.[7] ..... H01Q 11/12
(52) U.S. Cl. ..... 343/741; 343/742
(58) Field of Search ..... 343/741, 743, 343/742, 739, 732, 744, 866, 870

(56) References Cited

U.S. PATENT DOCUMENTS

| | | | | |
|---|---|---|---|---|
| 2,283,897 A | | 5/1942 | Alford | 250/33 |
| 2,372,651 A | | 4/1945 | Alford et al. | 250/33 |
| 2,490,815 A | * | 12/1949 | Kandoian | 250/33 |
| 3,284,801 A | * | 11/1966 | Bryant | 343/743 |
| 3,613,099 A | * | 10/1971 | Hollins | 343/742 |
| 5,751,252 A | | 5/1998 | Phillips | 343/726 |

OTHER PUBLICATIONS

Smith, "'Cloverleaf' Antenna for F.M. Broadcasting," Proceedings of the I.R.E. —Waves and Electrons Section, Dec. 1947, pp. 1556–1563.

Kandoian, "Coaxial Feed," Electronic Industries, May 1946, pp. 74–76, 122, 124, 126.

Kandoian, "Three New Antenna Types and Their Applications," Feb. 1946, pp. 70–75.

* cited by examiner

*Primary Examiner*—Don Wong
*Assistant Examiner*—James Clinger
(74) *Attorney, Agent, or Firm*—Kevin L. Daffer; Conley, Rose & Tayon P.C.

(57) ABSTRACT

An antenna includes a conductive loop with multiple feed points spaced around the loop. The loop may be opened at each feed point, thereby forming multiple loop portions. In an embodiment, the antenna may be a shielded loop antenna having multiple shielded feed lines. A kit including one or more components of such a shielded loop antenna may include a conductive structure in the form of a loop having multiple radial arms. In an embodiment of a method for forming an antenna, multiple feed points may be spaced apart around a conductive loop, and a respective feed line coupled to each of the feed points. In an embodiment, the feed lines may be shielded lines connected together at a shunt connection. The antenna may produce an isotropic radiation pattern similar to that of an electrically small antenna, but from an antenna of moderate electrical size.

29 Claims, 7 Drawing Sheets

MULTIPLY-FED LOOP ANTENNA

CROSS-REFERENCE TO RELATED APPLICATIONS

This application claims the benefit of U.S. Provisional Patent Application No. 60/296,542 by James S. McLean, filed on Jun. 6, 2001 and entitled "Multiply-Fed Loop Antenna."

BACKGROUND OF THE INVENTION

1. Field of the Invention

This invention relates to antennas and, more particularly, to a loop antenna of moderate electrical size having an omnidirectional far-field pattern similar to that of an electrically-small loop.

2. Description of the Related Art

The following descriptions and examples are not admitted to be prior art by virtue of their inclusion within this section.

Electric and magnetic dipole antennas having ideal omnidirectional patterns are very useful for design, operation and testing of various electromagnetic systems. For example, electric dipoles are often used to make so-called site attenuation measurements and for characterizing test sites used in testing antenna systems. Site attenuation measurements are essentially insertion loss measurements made with two precision dipoles carefully positioned a fixed distance apart. The deviation in insertion loss between the two dipoles as compared with the insertion loss between the dipoles in "free space" (actually, a reference site) gives an indication of the quality of a test site. However, the electric dipoles can mask some problems with a site in that they do not radiate in all directions; they exhibit radiation nulls located on their dipole axes. A magnetic dipole also has radiation nulls on its dipole axis (a perpendicular running through the center of the loop). However, by using two electric (horizontal and vertical) and two magnetic dipoles (horizontal and vertical), masking effects of the nulls may be overcome. An "omnidirectional" or "isotropic" pattern as used herein refers to a pattern having constant field amplitude with direction within a two-dimensional plane perpendicular to the axis of an electric dipole, or, in the case of a magnetic dipole loop, the plane containing the loop. In other words, the dipole cannot be literally omnidirectional because of its radiation nulls, but it is desirable that the dipole be omnidirectional in the plane perpendicular to the direction containing the nulls. Dipoles having such idealized patterns are needed to obtain accurate characterization of test sites.

Isotropic patterns are also desirable in mobile communications systems, in which the direction from which an incoming signal comes may be constantly changing. The large amount of scattering and reflection encountered in typical mobile communications systems makes it desirable to employ antennas with different polarizations, so that the chance of detecting a signal having an arbitrary polarization is increased. An electrically-small magnetic loop dipole radiates a dipolar pattern which is orthogonal to that of an electric dipole. Thus, such an antenna is useful when pattern diversity is required.

Electric (linear wire) and magnetic (loop) dipoles exhibit omnidirectional far-field patterns when used at frequencies for which they are electrically-small, or for which the physical size of the antenna is small compared to the wavelength of radiation. For the purposes of this disclosure, "electrically-small" refers to an antenna having its largest dimension smaller than about 1/10 of a wavelength. Electric dipoles having omnidirectional patterns may be realized fairly easily. A wire dipole exhibits a fundamental series resonance (the linear or wire dipole exhibits a minimum susceptance input admittance; it is an open circuit at DC) when it is slightly less than one-half wavelength long. At this point the input impedance to the dipole is about 73–80 Ohms and thus is very nearly intrinsically matched to a 50 Ohm source. Furthermore, the pattern of the so-called half-wave dipole differs only slightly from that of an electrically-small dipole. Patterns of ideal (electrically-small) and half-wave electric dipoles are discussed further in pages 200–222 of *Antennas* by John D. Kraus (McGraw-Hill, 1988, hereinafter "Kraus"), which pages are hereby incorporated by reference as if fully set forth herein.

Practical realization of a magnetic dipole having an omnidirectional pattern, on the other hand, is more difficult. A single-turn loop antenna, or magnetic dipole, exhibits its fundamental parallel resonance (a loop exhibits a minimum reactance input impedance; it is a short circuit at DC) at a frequency when it is very nearly one wavelength in circumference. However, the pattern of a self-resonant loop is completely different from that of an electrically-small loop, and is not omnidirectional. In fact, the maximum field amplitude is not even in the plane of the loop, as it is for the electrically-small loop. Patterns of magnetic dipoles of various electrical sizes are discussed further in pages 238–255 of Kraus, which pages are hereby incorporated by reference as if fully set forth herein.

A classical magnetic dipole therefore needs to be electrically-small to produce an omnidirectional pattern. There are several reasons, however, for using an antenna which is not electrically-small. An electrically-small loop has a very small radiation resistance and very high radiation Q. The high radiation Q corresponds to narrowband radiation characteristics. Furthermore, it is much easier to match an antenna of moderate electrical size to a 50-ohm source (50-ohm sources are most common, and other typical impedances, such as 75 ohms, are also relatively large). In a metrology antenna, the matching network can contribute significantly to measurement uncertainty. This is because of necessarily non-zero tolerances in matching components and because of temperature sensitivity of the matching components. In addition, at higher UHF frequencies and above it becomes difficult to implement an electrically-small antenna with precision. This is because the short wavelength requires a very physically-small antenna with the attendant tight dimensional tolerances. That is, the dimensional tolerances are related to the wavelength and the overall size of the antenna.

Finally, while in principle it is possible to scale any linear electromagnetic device, some details cannot easily be scaled in practice. For example, connectors and coaxial transmission lines are commercially available only in specific sizes and geometries. It is not at all worthwhile to design and manufacture custom connectors for a specific antenna. Furthermore, if custom connectors were developed, adapters to allow interconnection with industry-standard connectors would also be required. Thus, it is best if designs can employ standard coaxial connectors such as SMA connectors. If, for example, it were necessary to implement an electrically-small antenna at 2450 MHz, the antenna would be roughly the same size as the SMA connector. Obviously, in this case, the external geometry of the connector would influence the radiation pattern of the antenna. In most cases, it is useful if the external geometry of the connector and feed transmission line have minimal influence on the operation of the antenna.

Further discussion of the use of omnidirectional antennas and problems with electrically-small loops is included in U.S. Pat. No. 5,751,252 to Phillips (hereinafter "Phillips"), which is hereby incorporated by reference as if fully set forth herein. An approach described in Phillips to making an omnidirectional loop antenna involves "breaking" the loop at a point opposite the feed point of the loop, and bridging the break with a capacitive element. By effectively open-circuiting the loop at what would be the maximum current point of the (unbroken) loop, this approach lowers the overall current variation around the loop, resulting in a more omnidirectional pattern. The diameter of the loop described in Phillips is 1/7 of a wavelength, which although larger than a classical electrically-small loop, may still be undesirably small, particularly for operation at higher frequencies (e.g., greater than one GHz). There further appears to be no indication in Phillips of how the small capacitor values needed (0.7 pF at 800 MHz) are to be realized with the precision necessary for a metrology grade antenna.

Another approach is to simulate a large loop using four small loops connected in parallel across a coaxial line. This "cloverleaf" antenna is described on pages 731–732 of Kraus, which are hereby incorporated by reference herein. The cloverleaf antenna is a broadcasting antenna, and is not believed to exhibit sufficient omnidirectional uniformity for metrology applications. Driving of the small loops is further believed to result in a smaller bandwidth than would be realized by an actual large loop antenna.

It would therefore be desirable to develop a magnetic dipole antenna of moderate electrical size having an omnidirectional far-field pattern. The antenna should also be readily implemented and exhibit a bandwidth commensurate with its overall electrical size.

SUMMARY OF THE INVENTION

The problems outlined above are in large part addressed with an antenna including a conductive loop having multiple feed points spaced around the loop. The loop is opened at each feed point, and the feed points are preferably spaced evenly around the circumference of the loop. Four feed points spaced at 90 degree intervals are used in a currently preferred embodiment, but two, three or higher numbers of feed points may also be used in some embodiments. A respective feed line may be coupled to each of the feed points, and a structure for maintaining the portions of the discontinuous loop in position may be included. In an embodiment, the feed lines are balanced lines. A matching element may be included at each feed point.

In a currently preferred embodiment, the feeds are implemented using shielded lines, and the resulting loop antenna can be viewed as a multiply-fed shielded loop antenna. This shielded loop embodiment may be implemented by placing insulated feed wires into channels formed within a conductive structure. The channel therefore forms the outer conductor, or shield, for a coaxial line having the feed wire as an inner conductor. The conductive structure includes an outer loop and radial arms through which the feed lines are routed to a shunt connection at the center of the loop. The radial arms may be joined at the shunt connection, thereby providing mechanical support to maintain the positions of the portions of the discontinuous outer loop. The radial arms may meet the loop at positions equidistant between adjacent feed points. Each feed line may be routed from the central shunt connection out to the loop, then turn and follow the loop circumference to reach its respective feed point (gap in the loop). In an embodiment, the feed line is continued past the feed point to form an open-circuited transmission-line stub. Such a stub forms a series capacitance which may be used for impedance matching at the feed point.

A kit including one or more components of the shielded loop antenna described above may include a conductive structure in the form of a loop having multiple arms extending radially from the loop toward a point at the center of the area surrounded by the loop. The loop may include multiple portions separated by feed gaps. The conductive structure may include a respective channel extending from each feed gap and toward the point at the center of the area surrounded by the loop, where each channel is adapted to hold an insulated feed line. The channel may further include an extension past its respective feed gap, where the extension is adapted to hold a portion of insulated feed line forming an open-circuited transmission line stub. In an embodiment, the conductive structure may include two similar structure portions adapted to be fastened together after placement of the insulated feed lines between them. Each channel may be formed from a respective groove in at least one of these structure portions.

The kit may further include a conductive stem structure adapted for attachment to the arms of the conductive structure, where the conductive stem structure includes a conductive tube. The stem structure and the conductive structure are adapted such that an axis directed perpendicular to the plane of the loop and through the point at the center of the area surrounded by the loop is directed along the interior of the conductive tube when the stem structure is attached to the conductive structure. In a further embodiment, the kit may include insulated feed line adapted to be arranged within each of the channels in the conductive structure. The feed line may be adapted such that the characteristic impedance of the shielded line formed by arranging the feed line within the channel matches an impedance of the loop seen at the feed gap corresponding to the feed line. The kit may further include an insulated stem conductor line adapted to be arranged within the conductive tube of the conductive stem structure, and electrically coupled to a shunt connection of the feed lines arranged within all of the channels. The stem conductor line may be adapted such that its characteristic impedance when arranged within the stem structure causes a quarter-wave transformation of the impedance at the shunt connection to the impedance of a source or receiver to be coupled to the antenna.

The impedance (including matching elements) at each feed point preferably matches the characteristic impedance of its respective feed line. The impedance at the shunt connection of the feed lines may be matched to the source impedance using a quarter-wave transformer. The transformer may be included within a supporting stem for the antenna arranged along the perpendicular axis running through the center of the loop. This feed orientation is in the direction of a null in the radiation pattern, and therefore minimizes interference between the feed and the pattern.

Use of multiple feeds spaced around a loop antenna, as described herein, is advantageous in providing an omnidirectional pattern from a loop of moderate electrical size. Each loop portion between adjacent feed lines is relatively small electrically, and exhibits a substantially constant current distribution. The entire loop therefore has a constant current distribution, resulting in an omnidirectional pattern. The relatively large electrical size of the entire loop provides a large operational bandwidth and high radiation efficiency. In an embodiment, the loop diameter is approximately one-quarter of the operating wavelength, and the arc length of each separately-fed loop portion is less than about one-quarter of the operating wavelength. In the case of the shielded loop embodiment, the antenna may be implemented using precision machining techniques, allowing good control of critical dimensions.

In an embodiment of a method for forming an antenna, multiple feed points may be spaced apart around a conductive loop, and a respective feed line coupled to each of the feed points. The circumference of the loop divided by the number of feed points may be less than about a quarter of the operating wavelength of the antenna. In an embodiment, the feed lines may be shielded lines connected together at a shunt connection. An impedance at the shunt connection may be matched to that of a source for the antenna using a transformer. In an embodiment, the transformer is a quarter-wave transformer.

BRIEF DESCRIPTION OF THE DRAWINGS

Other objects and advantages of the invention will become apparent upon reading the following detailed description and upon reference to the accompanying drawings in which.

Figure 1:
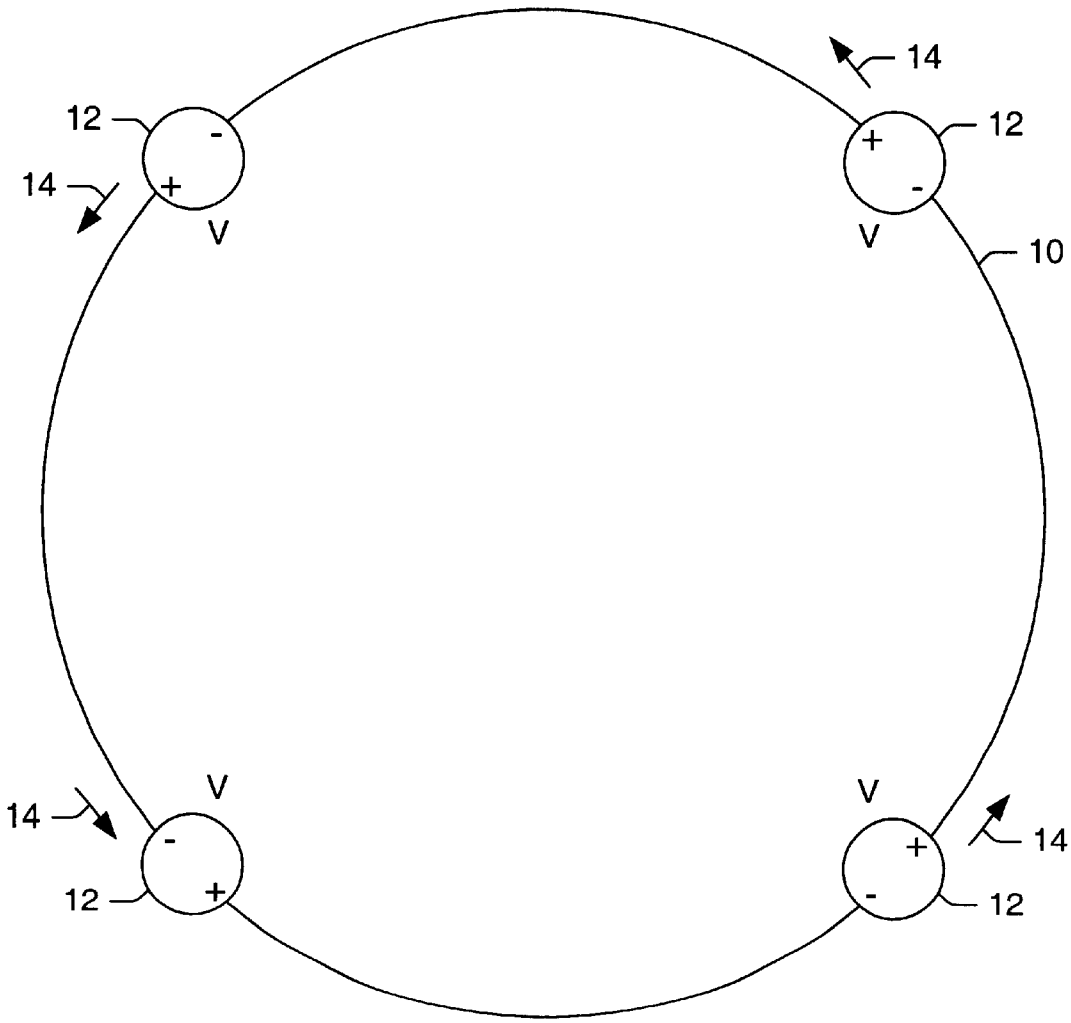
FIG. 1 illustrates a loop antenna fed by four voltage sources spaced around the loop.

While the invention may be modified and have alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

An antenna and method for forming an antenna are provided. FIG. 1 illustrates the antenna concept, in which a loop 10 is fed by multiple voltage sources 12 spaced around its circumference. The multiple feeds described herein, when connected to a source by respective feed lines, act as in-phase sources and drive a very nearly constant current around the loop, as illustrated by arrows 14. Each source sees the same driving-point impedance when the sources are evenly spaced around the loop as in the embodiment of FIG. 1. The sources are preferably evenly spaced around the loop, but may be spaced differently in some embodiments. Four sources are shown in the embodiment of FIG. 1, but two, three, or greater numbers of sources may be suitable in other embodiments.

Figure 2:
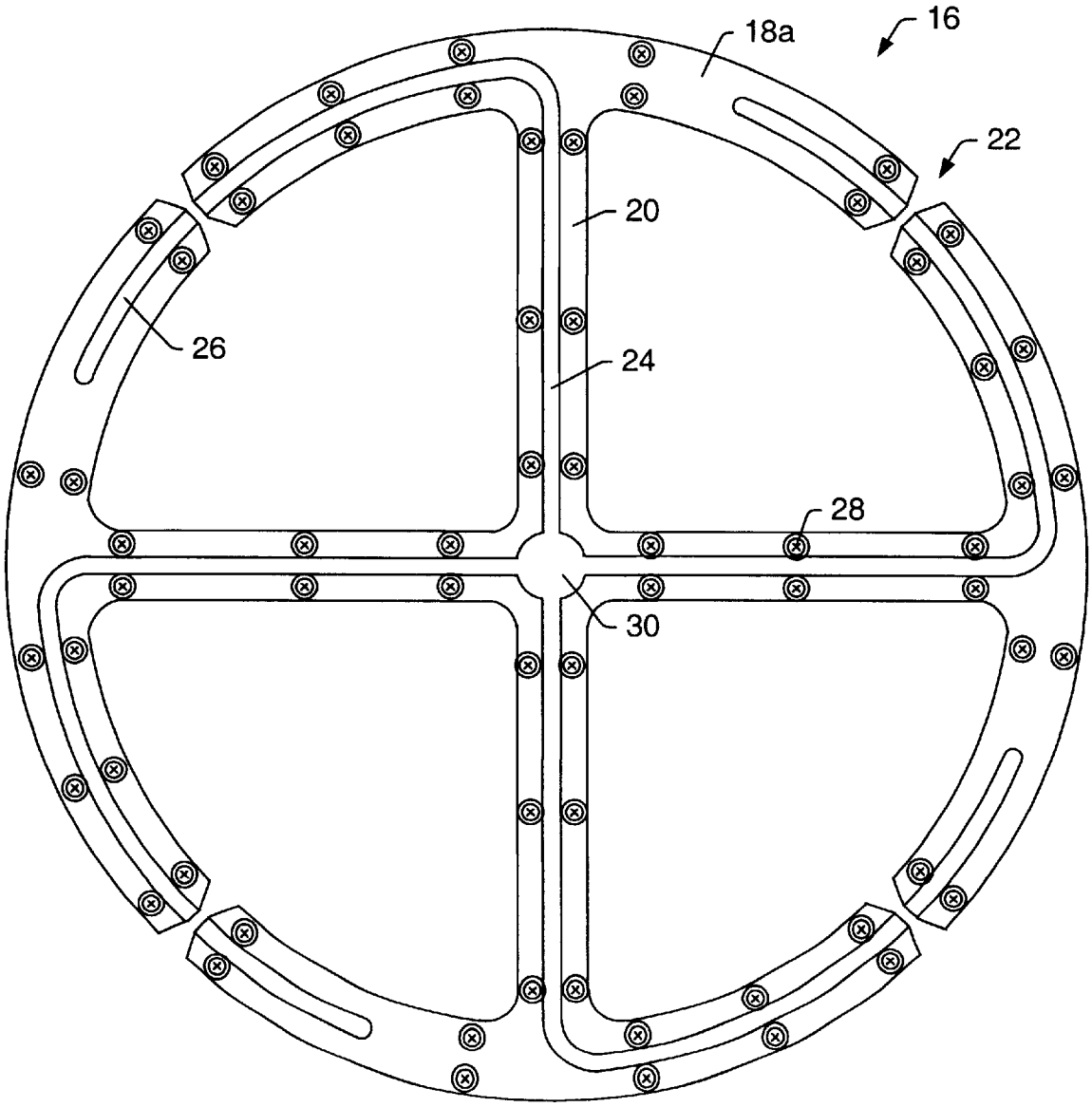
FIG. 2 shows a layout of a conductive structure used to form a shielded-loop embodiment of the antenna described herein.

The multiple sources of FIG. 1 may be implemented using balanced feed lines connecting a source to each of multiple gaps in the loop. Alternatively, a shielded feed line approach may be used. An exemplary layout of such a shielded loop configuration is shown in FIG. 2. In the embodiment of FIG. 2, conductive structure 16 includes a circular metal loop 18*a* with four radial arms 20 joining at the center of the loop. Four gaps, or feed points, 22 are spaced around the loop, and arranged equidistant between adjacent radial arms. A channel, or groove, 24 is cut into the metal structure along the center of each radial arm, with each channel turning and following the circumference of the loop until a feed point is reached. In this embodiment, each channel is then continued on the other side of the feed gap, so that an open-circuited transmission line stub can be formed within the channel portion 26 on the other side of the feed gap when an insulated line is placed within the channel. The insulated line bridges the feed gap when installed and continues in the channel on the other side. The insulated line is terminated before it reaches the end of the channel in order to prevent shorting of the feed line to the metal structure. The view of FIG. 2 shows one of two similar portions of the conductive structure of the antenna. After placement of the four insulated feed lines within the channels formed in the metal structure, a similar metal structure having corresponding channels is placed over the feed lines, and the two structure pieces are fastened together. In the embodiment of FIG. 2, they are fastened together using multiple screws 28 arranged throughout the structure, but other fastening techniques, such as clamps or conductive cements, soldering, brazing, etc. may also be suitable in other embodiments.

The feed gaps 22 are preferably made as small as practicable, with gap spacings on the order of one millimeter believed to give good results. In this way, radiation from the feed itself may be minimized with respect to the desired radiation from the loop. In the embodiment of FIG. 2, the loop portions are beveled back away from the insulated feed line crossing the gap, to help reduce the shunt capacitance across the feed gap. A hole 30 within the junction of the radial elements at the center of the loop allows the four feed lines to be connected together in parallel. In an embodiment, the feed lines are connected to an inner conductor of another coaxial line used to form a transformer. The transformer is discussed further below.

A traditional shielded loop antenna includes a shielded loop with a single break in the shield forming a feed gap, and a shielded feed line extending within the loop to a point 180° around from the feed gap, and then to the source through some sort of stem or mast. Using a shielded feed line to move the feed point to the other side of the loop from the stem creates symmetry that advantageously cancels current imbalances. In particular, the current flowing around the loop is not affected by currents flowing in the stem which intersects the loop; such currents are cancelled by equal and opposite currents. Shielded loop antennas are further described in pages 271–279 of *Ultrahigh Frequency Transmission and Radiation* by Nathan Marchand (John Wiley & Sons, New York, 1947) and in pages 5–19 through 5–21 of *Antenna Engineering Handbook, Third Edition*, edited by Richard C. Johnson (McGraw-Hill, 1993, hereinafter "Johnson"), said pages hereby incorporated by reference as if fully set forth herein. Despite the fact that the traditional shielded loop is perfectly symmetric about the line that intersects the feed gap and the stem, the radiation pattern is still perturbed by the presence of the stem and associated coaxial feed line. As discussed elsewhere herein, the invention here is fed from the direction of the radiation null of the loop. Thus, perturbation of the radiation pattern from that of an idealized isolated loop (with no feed transmission line) is minimized.

In a manner analogous to that for the traditional shielded loop, the current flowing around loop 18*a* of FIG. 2 is believed to be essentially unaffected by the radial arms 20 within the loop. The current on the feed line within a radial arm is balanced by an equal and opposite current on the interior surface of the conductive structure (along the inner surface of the channel surrounding the insulated feed line). The conductive structure is several skin depths thick, so that this current on the interior surface of the radial arm does not flow on or penetrate to the exterior surface of the radial arm. In fact, the exterior surface of the radial arms does not necessarily have to be conductive, as long as the interior surface surrounding the feed line is conductive (to a few skin depths thick). Placement of the radial arms such that they intersect the loop equidistant between adjacent feed gaps is believed to be helpful in establishing the symmetry causing the loop to not "see" the radial arms. Configurations in which each radial arm is not equidistant from the adjacent feed points may also provide suitable results, however.

Figure 3A:
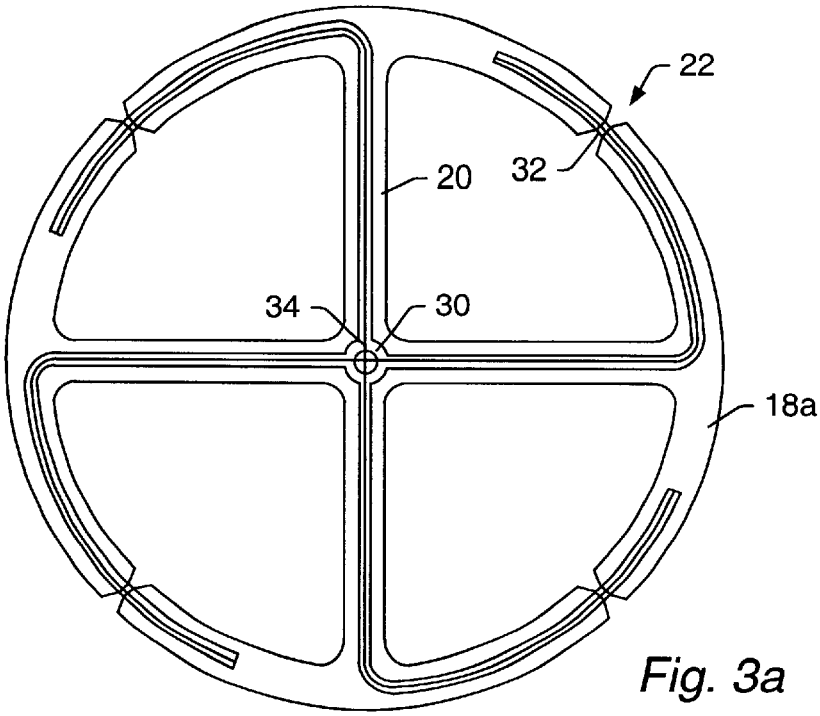
FIG. 3*a* is a top cross-sectional view of a shielded-loop embodiment similar to that of FIG. 2.
Figure 3B:
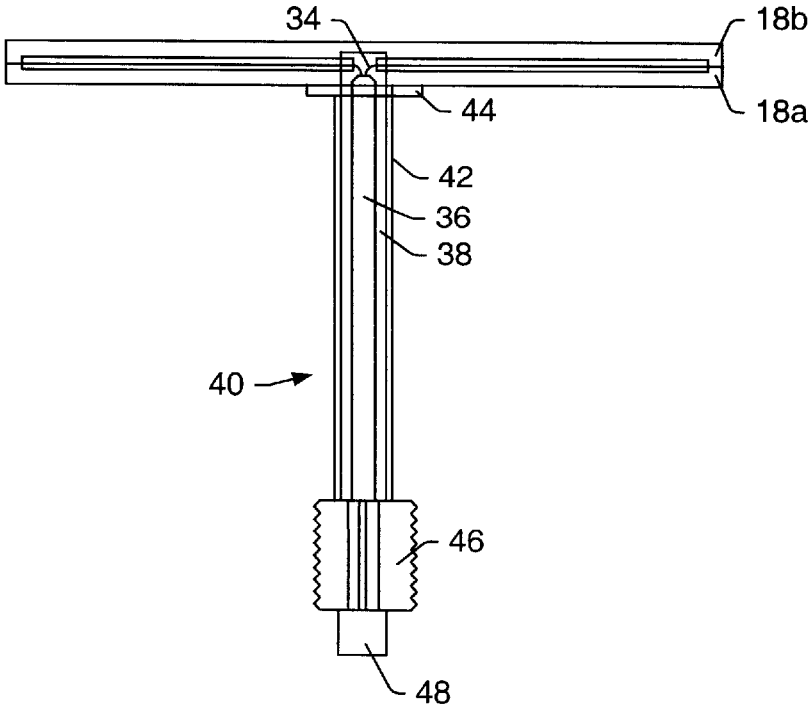
FIG. 3*b* is a side cross-sectional view of the antenna of FIG. 3*a;*
Figure 3C:
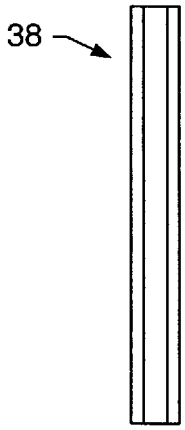
FIG. 3*c* is a side cross-sectional view of an insulating sleeve within the stem of the antenna of FIG. 3*b;*

Additional views of a shielded loop embodiment of the multiply-fed antenna described herein are shown in FIG. 3. FIG. 3*a* is a top view of a cross-section of the loop antenna structure, where the cross-section is in the plane of the loop and cuts through feed lines 32 arranged within channels 24 and crossing feed gaps 22. The view of FIG. 3*a* is similar to that of FIG. 2, with FIG. 3*a* also showing the top of a conductor to which the inner conductors 34 of the four feed lines are connected at the center of the loop. A cross-sectional side view of this antenna embodiment is shown in FIG. 3*b*. The closing of both pieces 18*a* and 18*b* of the conductive structure over the insulated feed lines can be seen in the view of FIG. 3*b*, as well as the connection of the feed lines to a conductor 36 within the antenna stem 40. The stem conductor 36 is surrounded by an insulating sleeve 38, a cross-section of which is shown in FIG. 3*c*. As shown in FIG. 3*b*, an outer conductor 42 surrounds the insulating sleeve to form a coaxial line. The outer conductor is attached (using a flange 44, in this embodiment) to the junction of the radial elements at the center of the loop antenna structure. The inner wall of outer conductor 42 may be aligned with the inner wall of the hole 30 in the center of the conductive structure portion 18*a*, as in the embodiment of FIG. 3*b*. A continuous current path between the inner surfaces of the feed line shields and the inner surface of the stem line shield is preferably provided.

In the embodiment of FIG. 3*b*, channels of semicircular cross-section are cut in each of the two conductive structure pieces 18*a* and 18*b*, such that the shields surrounding the insulated feed lines are apportioned equally from the two pieces. This may be a particularly suitable arrangement when the insulated line is formed using a circular coaxial cable with the outer conductor removed, since the circular shield formed in the conductive structure may effectively replicate the shield dimensions from the cable, and thereby preserve the cable's characteristic impedance. Other channel shapes may also be suitable, however, such as formation of deeper channels in only one of the pieces, and use of the other piece as a cap over the feed lines. Alterations of the channel cross-section may be used to tailor the characteristic impedance of the feed line and/or to accommodate various feed line cross-sections.

The dimensions and material properties of stem inner conductor 36 and insulating sleeve 38 are preferably chosen such that the transmission line in the stem 40 forms a quarter-wave matching transformer, matching the resistance at the shunt connection of the feed lines to the resistance of the source to be used to drive the antenna (or receiver to which the antenna is connected). A quarter-wave transformer is formed when the characteristic impedance of the transmission line is equal to the square root of the product of the resistances at each end of the transmission line. Transmission line transformers are further discussed in pages 43-9 through 43-12 of Johnson, which pages are hereby incorporated by reference as if fully set forth herein.

Figure 4C:
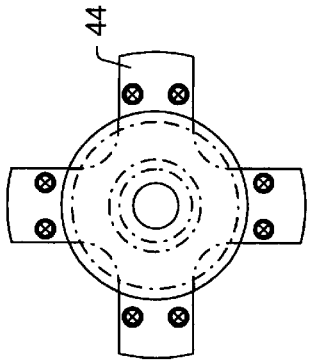
FIG. 4*c* is a bottom view of the stem housing of FIG. 4*b;*
Figure 4B:
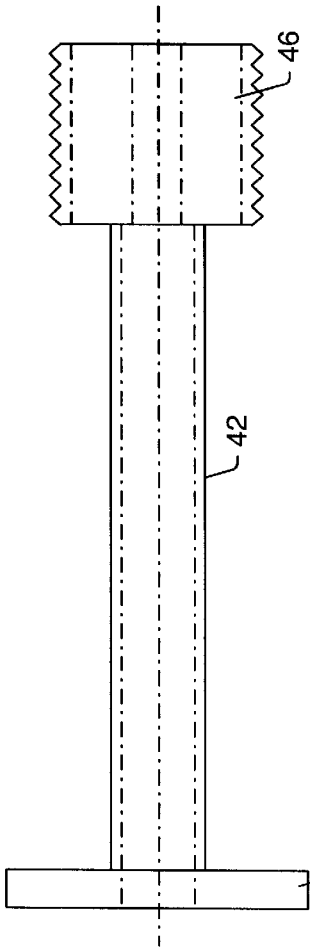
FIG. 4*b* is a side view of the stem housing of FIG. 4*a;*
Figure 4A:
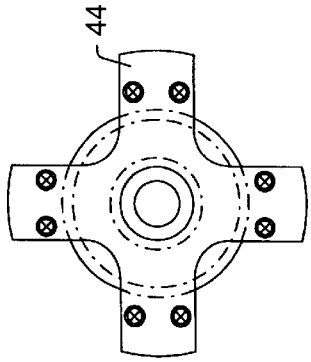
FIG. 4*a* is a top view of the stem housing for the antenna of FIG. 3.

In the embodiment of FIG. 3, a threaded section 46 is provided at the bottom of the stem for connection to a tripod or other supporting device. The inner diameter of the threaded portion surrounds a section of coaxial line attached to an SMA ("subminiature type A") connector 48. The SMA connector is a compact coaxial connector used in this embodiment for connecting the antenna to a signal source or receiver, but other types of connector may also be suitable in other embodiments. The SMA connector and its associated coaxial cable portion are typically adapted for use with a 50-ohm load, but other connector impedances may be used in other embodiments. FIG. 4 shows top, side and bottom views of the housing for the antenna stem of FIG. 3*b*, including the outer conductor, threaded section 46, and top flange portion 44 for connection to antenna structure portion 18*a*.

An exemplary antenna has been fabricated with a structure as shown in FIGS. 2–4. Metal portions of the antenna were fabricated by CNC machining of stainless steel. The outer diameter of the loop for this antenna is about 9.8 cm, and the inner loop diameter is about 8.5 cm. The impedance seen by each of the feed points for this geometry, without any matching elements, was calculated to be about 50+j300 at 900 MHz, or 50 ohms resistance and 300 ohms inductive reactance. The length of the transmission line stub formed adjacent each feed gap was therefore calculated in order to provide a capacitance to cancel the inductance at the feed point. The channel formed for the transmission line stub was made slightly longer than the actual stub length, so that short-circuiting of the feed line conductor to the conductive structure could be prevented. There is no DC connection of the feed line to the conductive loop in this shielded-loop implementation of the multiply-fed antenna; the shielded-loop implementation is a capacitively-coupled antenna. The matched antenna should therefore have a 50 ohm resistance at each feed point in this embodiment. This impedance is therefore matched to a shielded feed line having a 50 ohm characteristic impedance. In the fabricated antenna, this 50-ohm line was implemented using semi-rigid Teflon-insulated 50-ohm coaxial line from which the outer conductor was removed. The lines were placed into the appropriate channels machined into the conductive structure, and soldered to the stem inner conductor.

The resistance at the shunt connection of the four 50-ohm lines in this fabricated antenna is therefore 12.5 ohms. The properties of the coaxial line in the stem of the antenna were chosen to provide a quarter-wave transmission line transformer matching the 12.5 ohm resistance to a 50 ohm source or load. For this particular antenna, the stem inner conductor was about one-eighth of an inch in diameter, the outer diameter of the stem dielectric sleeve was about one quarter of an inch, and the stem length about 2.25 inches. Although the matching elements (transmission line stubs and quarter-wave transformer) were designed for a 900 MHz antenna, testing showed that the antenna was tuned at about 805 MHz. This inaccuracy is believed to be due to parasitic quantities such as the shunt capacitances across the feed gaps. Such inaccuracies may be accounted for in various ways, however, such as by scaling the structure. The antenna was found to exhibit at least 15% bandwidth having a return loss of 24 dB. In applications for which a 2:1 voltage standing wave ratio (VSWR) is acceptable, it is believed that about 30% bandwidth could be obtained.

Figure 5:
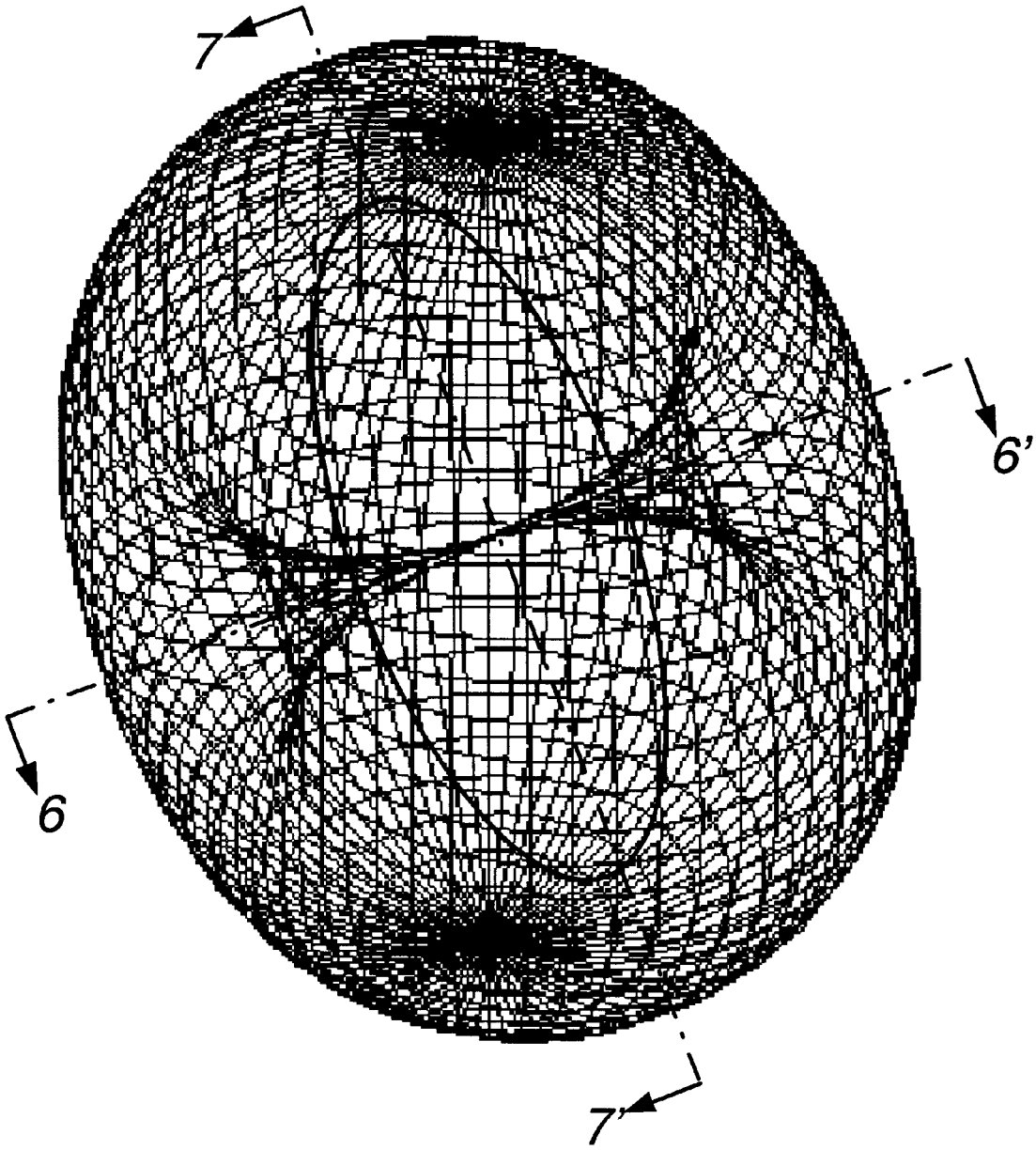
FIG. 5 is a three-dimensional plot of a calculated radiation pattern for a multiply-fed loop antenna as shown in FIG. 1.
Figure 6:
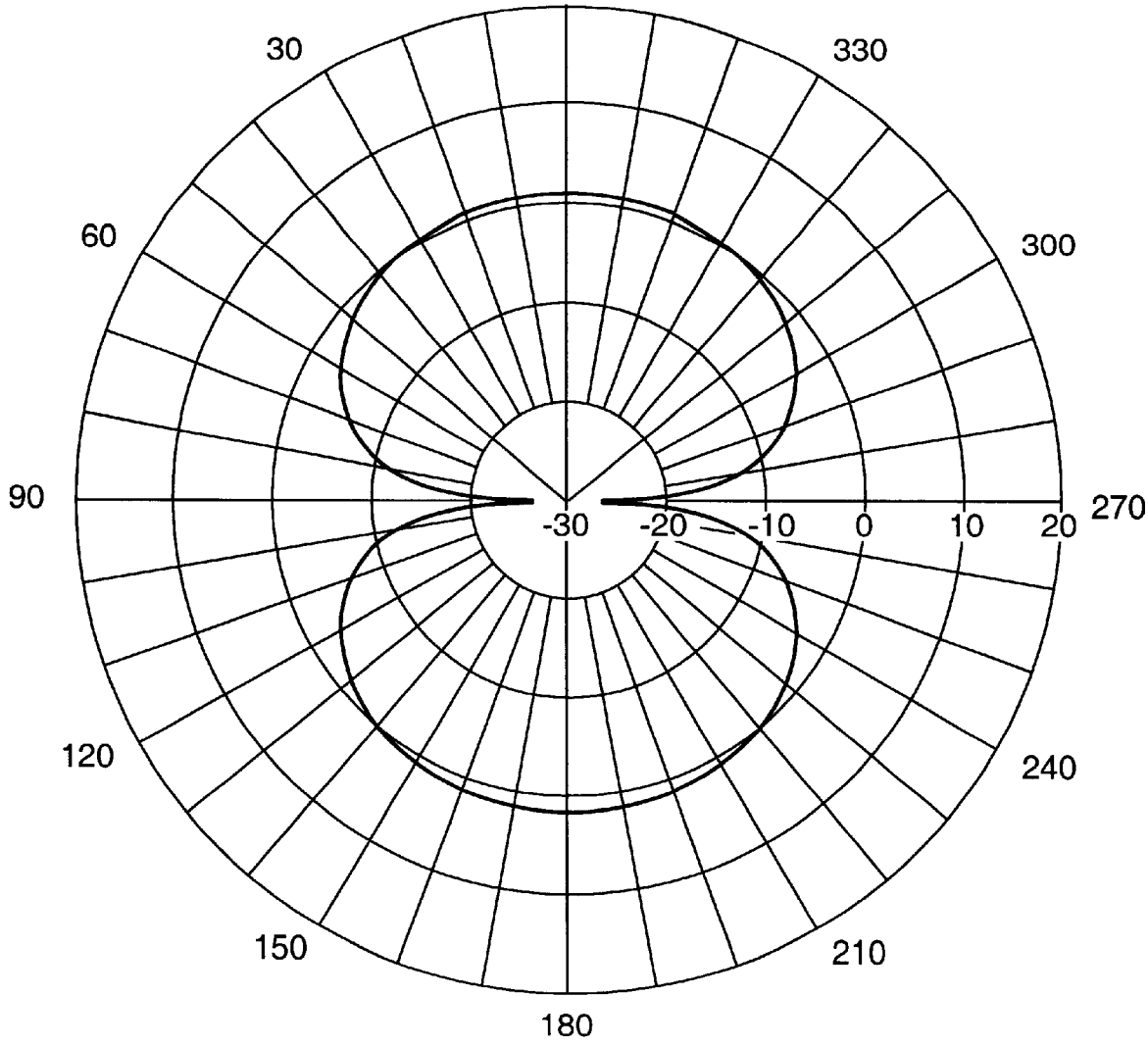
FIG. 6 is a two-dimensional plot of the radiation pattern along cut 6–6' of FIG. 5.
Figure 7:
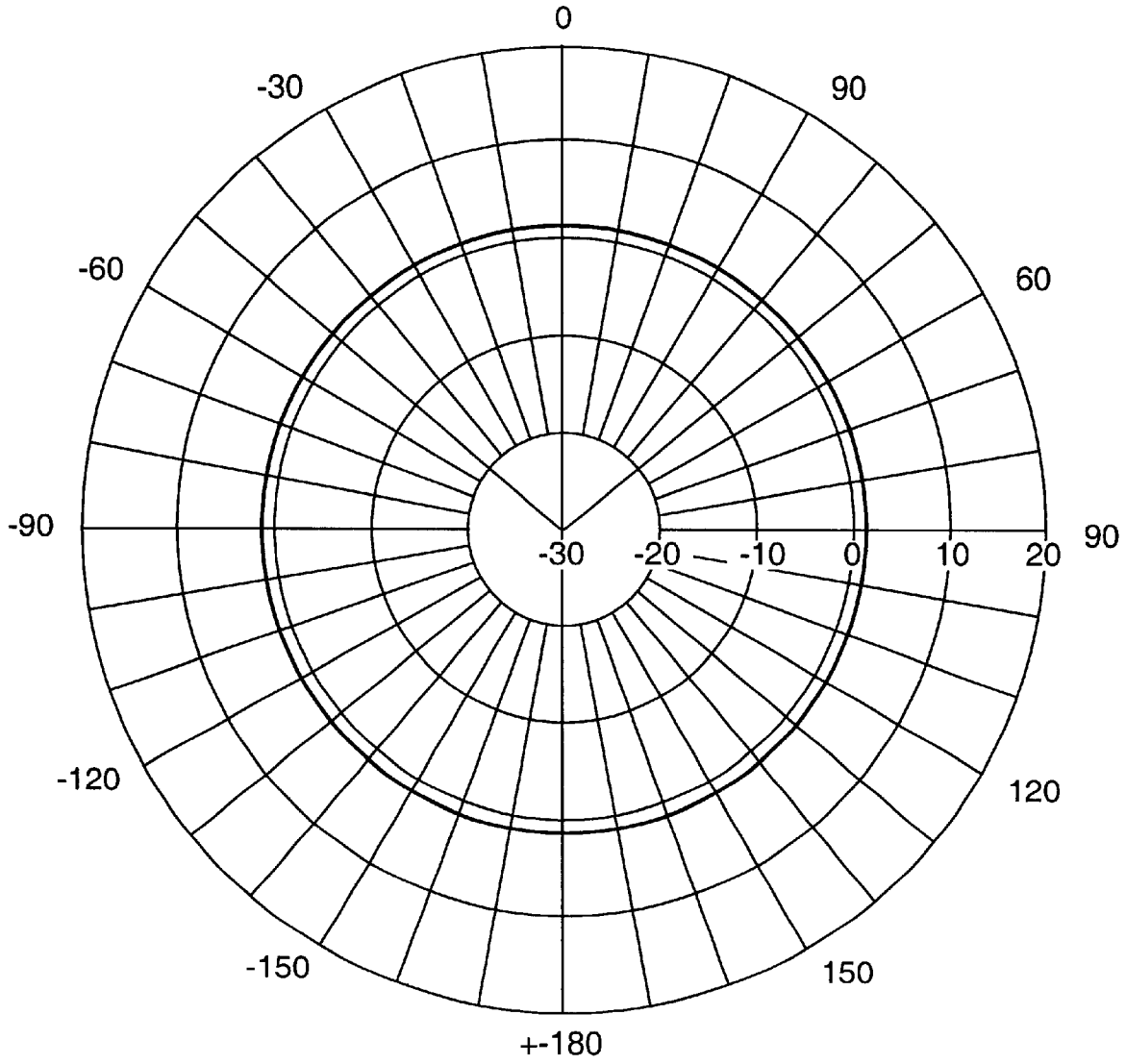
FIG. 7 is a two-dimensional plot of the radiation pattern along cut 7–7' of FIG. 5.

FIGS. 5–7 show calculated radiation patterns for a multiply-fed loop antenna represented by a wire model such as that of FIG. 1. The calculations are made using a wire-model method-of-moments approach. Such calculations may be made using, for example, version 2 of the Numerical Electromagnetics Code (NEC-2), available from Lawrence Livermore National Laboratory in Livermore, Calif. FIG. 5 is a three-dimensional plot of the electric and magnetic far field calculated for a loop antenna having four feeds and operating at 900 MHz. The orientation of the loop is indicated on the plot. It can be seen that the pattern is very similar to the "donut" pattern characteristic of an electrically-small loop. FIG. 6 shows the calculated pattern along cut 6–6' of FIG. 5, in a plane perpendicular to that of the loop (also called the "H-plane"). The calculated maximum gain of 1.56 dB occurs at both the front (0°) and back (180°) of the antenna. The calculated 3 dB beamwidth, or the angle over which the calculated gain is within 3 dB of the maximum gain, is 100 degrees. FIG. 7 shows the calculated pattern along cut 7–7' of FIG. 5, in the plane of the loop (also called the "E-plane"). The circular pattern of FIG. 7 is a result of the very nearly constant loop current, in magnitude and phase, created by the multiple-feed arrangement of FIG. 1. The calculated patterns indicate that the quadruply-fed antenna provides a nearly perfectly isotropic E-plane radiation pattern while providing a cosine pattern in the H-plane.

The antenna designs discussed above are merely exemplary, and many variations are possible and contemplated. As noted above, for example, a different number of feeds than four could be used. A general design consideration is that the loop portions between the feed gaps should be electrically-small enough that the current distribution on each one when driven is essentially constant along its length. An arc-length of less than about a quarter of a wavelength is believed to be suitable, though longer lengths may work in some embodiments. Electrically-shorter portions should provide even more uniform current distributions. To increase the overall electrical size of a multiply-fed loop design, therefore, it may be appropriate to increase the number of feeds in order to maintain relatively electrically short loop portions. The feed-point impedance varies with the number of feeds for a loop of a given size, with a higher number of feeds corresponding to a lower impedance per feedpoint. Another general design consideration is that the feedpoint impedance should be matched to the characteristic impedance of the feed line, so the feed line impedance should be adjusted to match the feed point impedance to the extent practicable. Furthermore, increasing the number of feeds further lowers the impedance at a shunt connection of the feed lines, so that the matching transformer of the embodiment of FIGS. 3 and 4 would need to be adjusted.

Although a coaxial cable with the outer conductor removed was described above as a way to form an insulated feed line, many other ways are possible. For example, a conductor could be patterned on an insulating circuit board portion and capped with another circuit board portion. Furthermore, the embodiments described herein are operated at frequencies below the first parallel resonance of the loop (occurring when the loop circumference is about one wavelength). Below this resonance, the feed point reactance is inductive. If enough feeds were used, however, it might be possible to form an antenna operating at a frequency above the resonance, in which case the feed point reactance would be capacitive. In such an embodiment, an inductive, rather than capacitive, element would be needed to cancel the reactance at the feed point.

It will be appreciated by those skilled in the art having the benefit of this disclosure that this invention is believed to provide an antenna of moderate electrical size having an isotropic radiation pattern similar to that of an electrically small antenna, components for forming an embodiment of such an antenna and a method of forming such an antenna. Further modifications and alternative embodiments of various aspects of the invention will be apparent to those skilled in the art in view of this description. It is intended that the following claims be interpreted to embrace all such modifications and changes and, accordingly, the specification and drawings are to be regarded in an illustrative rather than a restrictive sense.

What is claimed is:

1. An antenna, comprising a conductive loop having multiple feed points spaced around the loop, wherein a circumference of the loop divided by the number of the multiple feed points is less than about a quarter of the operating wavelength of the antenna.

2. The antenna of claim 1, wherein the feed points are spaced evenly around the loop.

3. The antenna of claim 1, wherein the loop is opened at each feed point, thereby forming multiple loop portions.

4. The antenna of claim 3, further comprising a structure for maintaining positions of the loop portions.

5. The antenna of claim 1, further comprising a respective feed line coupled to each of the feed points.

6. The antenna of claim 5, further comprising a respective matching element coupled to each feed line at the respective feed point.

7. The antenna of claim 5, wherein each feed line comprises an insulated wire arranged in a respective channel formed within the conductive loop, and wherein each feed line is capacitively coupled to the loop at the feed point.

8. The antenna of claim 7, wherein the conductive loop is part of a conductive structure having multiple arms extending radially from the loop toward a point at the center of the area surrounded by the loop.

9. The antenna of claim 8, wherein each channel formed within the conductive loop further extends along one of the arms of the conductive structure, and wherein all of the feed lines are connected in shunt at the point at the center of the area surrounded by the loop.

10. The antenna of claim 9, further comprising a supporting stem for the antenna arranged along an axis perpendicular to the plane of the loop, wherein the axis is directed through the point at the center of the area surrounded by the loop.

11. The antenna of claim 10, further comprising a quarter-wave transformer matching the shunt connection of the feed lines to an impedance of a source or receiver to be coupled to the antenna, wherein the quarter-wave transformer is formed within the supporting stem.

12. The antenna of claim 7, wherein the respective channel and feed line extend along the loop past each feed point to form an open-circuited transmission line stub.

13. An antenna, comprising:

a conductive loop having multiple feed points spaced around the loop; and a respective feed line coupled to each of the feed points, wherein each feed line comprises an insulated wire arranged in a respective channel formed within the conductive loop, and wherein each feed line is capacitively coupled, but not directly coupled, to the loop at the feed point.

14. A method for forming an antenna, said method comprising:

spacing multiple feed points around a conductive loop, wherein the loop circumference divided by the number of the multiple feed points is less than about a quarter of the operating wavelength of the antenna; and coupling a respective feed line to each of the feed points.

15. The method of claim 14, wherein said spacing feed points comprises spacing feed gaps.

16. The method of claim 14, wherein said coupling comprises capacitively coupling a shielded line to each of the feed points.

17. The method of claim 16, further comprising joining the feed lines together in a shunt connection.

18. The method of claim 17, further comprising transforming the impedance of the shunt connection to the impedance of a source or receiver.

19. The method of claim 18, wherein said transforming comprises coupling a quarter-wave transformer to the shunt connection.

20. A kit including one or more components of an antenna, said kit comprising a conductive structure in the form of a loop having multiple arms extending radially from the loop toward a point at the center of the area surrounded by the loop, wherein the loop includes multiple loop portions separated by feed gaps, and wherein a circumference of the loop divided by the number of the multiple loop portions is less than about a quarter of the operating wavelength of the antenna.

21. The kit of claim 20, wherein the conductive structure includes a respective channel extending from each feed gap and toward the point at the center of the area surrounded by the loop, and wherein each channel is adapted to hold an insulated feed line.

22. The kit of claim 21, wherein the conductive structure comprises two similar structure portions adapted to be fastened together after placement of the insulated feed lines between them, and wherein each channel is formed from a respective groove in at least one of the structure portions.

23. The kit of claim 21, wherein each channel includes an extension past its respective feed gap, and wherein the extension is adapted to hold a portion of insulated feed line forming an open-circuited transmission line stub.

24. The kit of claim 21, further comprising a conductive stem structure adapted for attachment to the arms of the conductive structure, wherein the conductive stem structure comprises a conductive tube, and wherein the stem structure and conductive structure are adapted such that an axis directed perpendicular to the plane of the loop and through the point at the center of the area surrounded by the loop is directed along the interior of the conductive tube when the stem structure is attached to the conductive structure.

25. The kit of claim 24, further comprising insulated feed line adapted to be arranged within each of the channels in the conductive structure, wherein the feed line is adapted such that a characteristic impedance of the feed line when arranged within the channel matches an impedance of the loop seen at the respective feed gap.

26. The kit of claim 25, further comprising an insulated stem conductor line adapted to be arranged within the conductive tube and electrically coupled to a shunt connection of the feed lines arranged within all of the channels.

27. The kit of claim 26, wherein the stem conductor line is further adapted such that its characteristic impedance when arranged within the stem structure causes a quarter-wave transformation of the impedance at the shunt connection to an impedance of a source or receiver.

28. A method for forming an antenna, said method comprising:

spacing multiple feed points around a conductive loop; and capacitively coupling, but not directly coupling, a shielded line to each of the feed points.

29. A kit including one or more components of an antenna, said kit comprising a conductive structure in the form of a loop having multiple arms extending radially from the loop toward a point at the center of the area surrounded by the loop, wherein:

the loop includes multiple loop portions separated by feed gaps;

the conductive structure includes a respective channel extending from each feed gap and toward the point at the center of the area surrounded by the loop;

each channel is adapted to hold an insulated feed line;

the conductive structure comprises two similar structure portions adapted to be fastened together after placement of insulated feed lines between them; and each channel is formed from a respective groove in at least one of the structure portions.

* * * * *